United States Patent [19]

Jernberg

[11] Patent Number: 4,667,708

[45] Date of Patent: May 26, 1987

[54] METHOD AND APPARATUS FOR FILLING TANKS WITH LIQUIFIED GAS

[75] Inventor: Robert H. Jernberg, East Hampton, Conn.

[73] Assignee: Pressure Pak, Inc., East Hampton, Conn.

[21] Appl. No.: 819,727

[22] Filed: Jan. 17, 1986

[51] Int. Cl.[4] ..... B65B 3/04

[52] U.S. Cl. ..... 141/1; 141/83; 141/269; 53/403

[58] Field of Search ..... 141/1-12, 141/37-83, 94, 95, 96, 18-27, 382-387, 250-284, 285-310, 346-362; 62/50-55; 53/403

[56] References Cited

U.S. PATENT DOCUMENTS 4,582,100 4/1986 Poulsen ..... 141/83

*Primary Examiner*—Houston S. Bell, Jr.

*Attorney, Agent, or Firm*—Chilton, Alix & Van Kirk

[57] ABSTRACT

An automated system for charging container with a liquefied refrigerant gas or like fluid employs a fill head assembly which is adapted to be controllably lowered onto the container. The fill head has a vacuum source assembly which connects with a low pressure source and a fluid supply source which connects with a source of pressurized fluid. A fluid passageway selectively communicates with the low pressure source and the pressurized fluid source. The fill head may be released so that fill head essentially rests on the container which is being filled and the container is automatically sequentially evacuated and filled with a pre-established amount of pressured fluid until a pre-established net weight is obtained. The system is controlled by a programmable controller.

16 Claims, 8 Drawing Figures

METHOD AND APPARATUS FOR FILLING TANKS WITH LIQUIFIED GAS

BACKGROUND OF THE INVENTION (1) Field of the Invention

This invention relates generally to the filling of containers with a pressurized fluid. More particularly, the present invention relates to a system and apparatus for the automated filling of pressurized fluid containers such as are employed for storing liquified gases.

Generally, the filling of pressurized fluid containers such as tanks or cylinders for holding a liquified gas involves the evacuating of residual air from the tank to thereby create a low pressure condition within the tank and the injecting of the pressurized fluid into the evacuated tank. The tanks are conventionally provided with a manually operable valve which may include a threaded nozzle for charging and discharging the tank.

(2) Prior Art

In U.S. Pat. No. 4,557,300 of the inventor of the invention and entitled "METHOD OF AND APPARATUS FOR FILLING PRESSURIZED FLUID CONTAINERS" a pressurized fluid container filling system employs a first support platform assembly which supports a plurality of pressurized fluid containers for evacuating the containers. A vacuum supply assembly connects a vacuum source to the fluid containers supported on the first platform assembly via supply lines which connect to the container valves. A second support assembly is employed for supporting the plurality of pressurized fluid containers for filling the containers. A pressurized fluid assembly for supplying the pressurized fluid to the containers employs at least one supply line for connection to the container valves. A valve clamp assembly sequentially interconnects the valve of the container to the vacuum and fluid supply assemblies. The valve clamp assembly has a quick disconnect valve for rapid connection and disconnection with the fluid supply line and the vacuum supply line. The valve clamp assembly employs a valve seat assembly for press sealing connection to the nozzle of the container valve and a releasable clamp for clamping the nozzle of a container valve into the sealing engagement with the valve seat assembly.

The present invention is a new and improved method and apparatus for filling tanks with a liquified gas which method and apparatus employs a programmed controller to provide a highly automated and highly efficient filling system.

BACKGROUND OF THE INVENTION

Briefly stated the invention in a preferred form is an automated system for charging containers with a liquified gas such as a refrigerant gas or a like fluid. The system is especially adaptable for use with containers of a type having a valve controlled by a rotatable handle. A platform receives and supports a container to be filled in a generally upright orientation. A fill head adapted to be controllably lowered onto the received container comprises a vacuum valve assembly which connects with a vacuum pump and a pressurized fluid valve assembly which connects with a source of pressurized fluid. A fluid passageway is selectively communicatable with the vacuum source and the pressurized fluid assembly. A clamp clamps a valve seat in a pressure engagable fluid tight relationship with the valve of the container to provide fluid communication between the fill head and the container. A vacuum valve assembly selectively controls communication between the vacuum source and the container valve opening. A fluid valve assembly selectively controls communication between the fluid assembly and the container valve opening. A decoupling assembly controllably releases the fill head to allow the fill head to rest on the received container and become part of the tare weight so that the container may be automatically sequentially evacuated and filled with a pre-established amount of pressurized fluid as determined by either weight or pressure.

A torque head may also be employed to automatically close the container valve after the container is filled with the pre-established amount of fluid. The decoupling assembly comprises a control rod having a collar mounted at the end of the rod and a coupling plate mounted in fixed relationship with the fill head so that the control rod may be positioned in a first operational mode where the collar engages the plate to support the fill head and may also be positioned in a second operational mode where the collar disengages from the plate to allow the fill head to freely rest on the vessel. The clamp further comprises a pair of automatically controlled clamp arms which cooperate to clamp the valve seat in a pressure engagable fluid tight relationship with the valve of the pressure vessel. A vacuum sensing means is also employed to sense a leak in the container. The torque assembly includes a head which forms a cup like cavity with a pair of spring mounted pins projecting into the cavity. The pins engage the valve handle for rotating the handle to a closed position. A weighing platform for weighing the container and fill head means to determine the tare weight of the contents of the container is also employed. A programmable controller means automatically sequentially controls the operation of the fill head, the clamp, the vacuum control assembly, the fluid control and the decoupling assembly.

A method for charging containers with a liquified refrigerant gas or a like fluid comprises orienting the container to be charged in a generally upright orientation on a rotating platform. A fill head assembly is lowered onto the container so that the fill head assembly freely rests on the container. A fill head is clamped to the container to provide fluid communication therebetween. The container is evacuated until a pre-established low pressure threshhold is obtained. The container and fill head assemblies are weighed to determine the tare weight of the contents of the vessel and the container is filled with fluid until the fluid contents reach a pre-established weight.

The evacuating step further comprises opening and closing a vacuum valve to provide selective fluid communication with a source of low pressure. The filling step further comprises opening and closing a pilot valve to provide selective communication with the source of pressurized fluid. The container is automatically closed after the container has been filled. The closing of the container is delayed for a pre-established time interval subsequent to the closing of the pilot valve to allow residual fluid to drain into the container. The steps may be automatically sequentially controlled by a programmable controller. The method also includes automatic means for detecting a leak in the container and for determining whether the container is properly positioned on the platform assembly.

An object of the present invention is to provide a new and improved method and apparatus for filling tanks with a liquified refrigerant gas.

Another object of the invention is to provide a new and improved filling system which is highly automated and may be automatically controlled by a computer operated controller.

A further object of the invention is to provide a new and improved automated filling system which permits rapid evacuation and filling of a container without requiring that the container be transported to a separate station.

A further object of the invention is to provide a new and improved filling system which is highly automated and contains automated means for rejecting defective and/or misloaded containers.

Other objects and advantges of the invention will become apparent from the specification and the drawing.

DETAILED DESCRIPTION OF THE INVENTION

Figure 1:
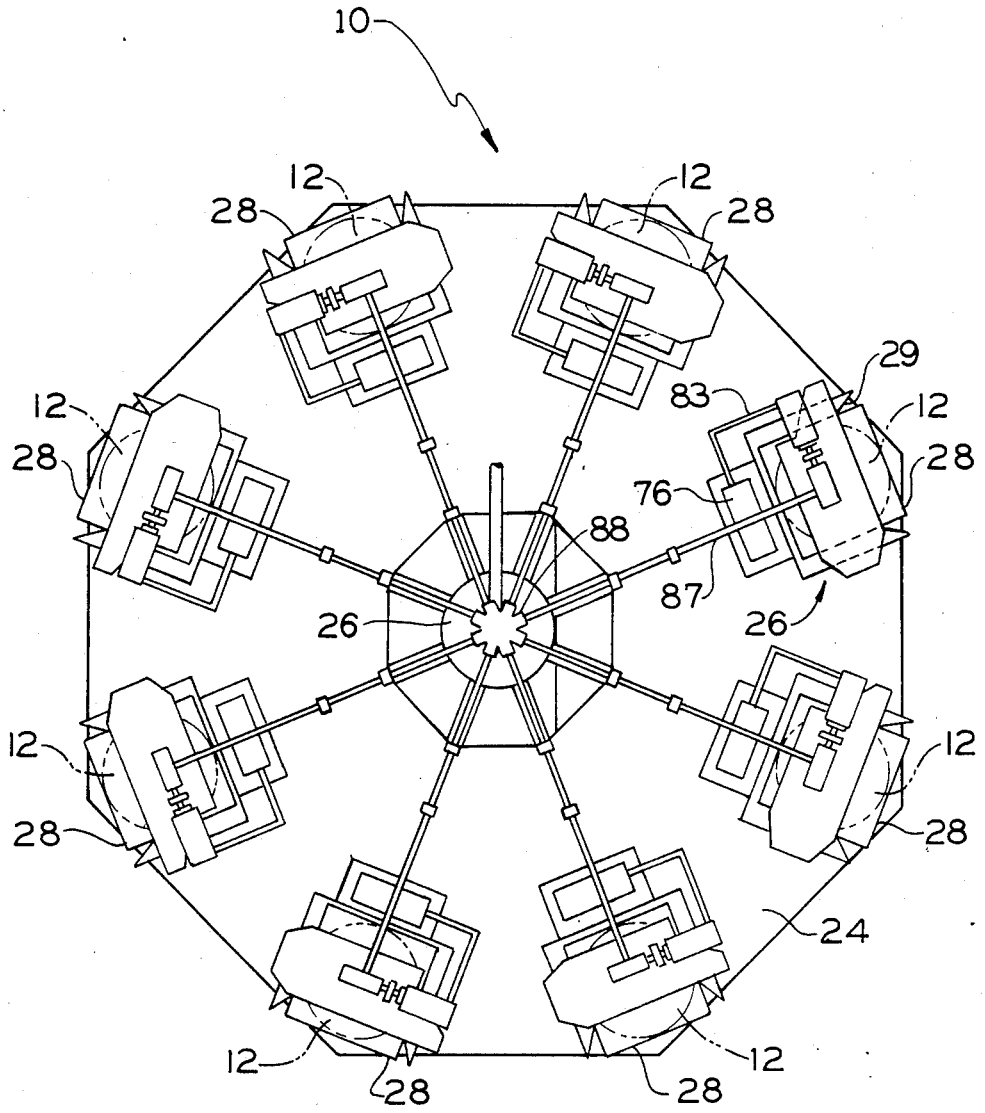
FIG. 1 is a diagramatical plan view of an automated system in accordance with the present invention.

With reference to the drawings wherein like numerals represent like parts throughout the several FIGURES, an automated filling assembly in accordance with the present invention is generally designated by the numeral 10. Although automated filling asembly 10 has numerous applications, in a preferred application assembly 10 is employed to automatically evacuate a container 12 and to fill the container with a pressurized fluid such as a liquified refrigerant gas or liquified gases such as propane, butane, carbon dioxide or nitrous oxide.

The containers or tanks 12 to which the invention has particular suitablility conventionally employ a valve 14 (best illustrated in FIG. 6) which is generally permanently mounted to the top of the tank 12. Valve 14 is an in-line manually operated flow control valve which is used for filling and discharging or evacuating the tank 12. A rotatable handle 16 is connected to a valve stem 18 mounted within the valve body 20 for opening and closing a fluid flow path between the exterior and the interior of the tank through a threaded connector nozzle 22 at the terminus of the valve.

The automated filling assembly 10 comprises a platform assembly 24 rotatably mounted about a hub for rotation in a horizontal plane. A plurality of angularly spaced work stations 26 are mounted in a fixed generally up-standing orientation relative to the support assembly for fixed rotation with the support assembly. Each assembly unit preferably comprises 8 or 16 substantially identical work stations with each work station 26 being dimensioned and configured to support and receive a single refrigerant container 12 for evacuation and filling. Each such work station is further configured to receive a pre-packaged, self-oriented container. The container 12 is pre-packaged in a box 28 in a fashion which preferably fixes the container for proper positioning upon being received by the assembly. The container 12 and associated box 28 are received as a unit in a three-sided nest 29 of a work station and supported on a platform 30 which continuously rotates with the support assembly. The container valve 14 is open when the container is initially loaded in the work station. Upon termination of the evacuation and filling process, the boxed container is ejected from the filling assembly to an automated carrier (not illustrated) for conveyance to be packaged in final form and loaded for transport from the facility. Each of the work stations is substantially identical and functions in substantially the same manner, and therefore only one such work station 26 will be described in detail for purposes of describing the invention.

Figure 2:
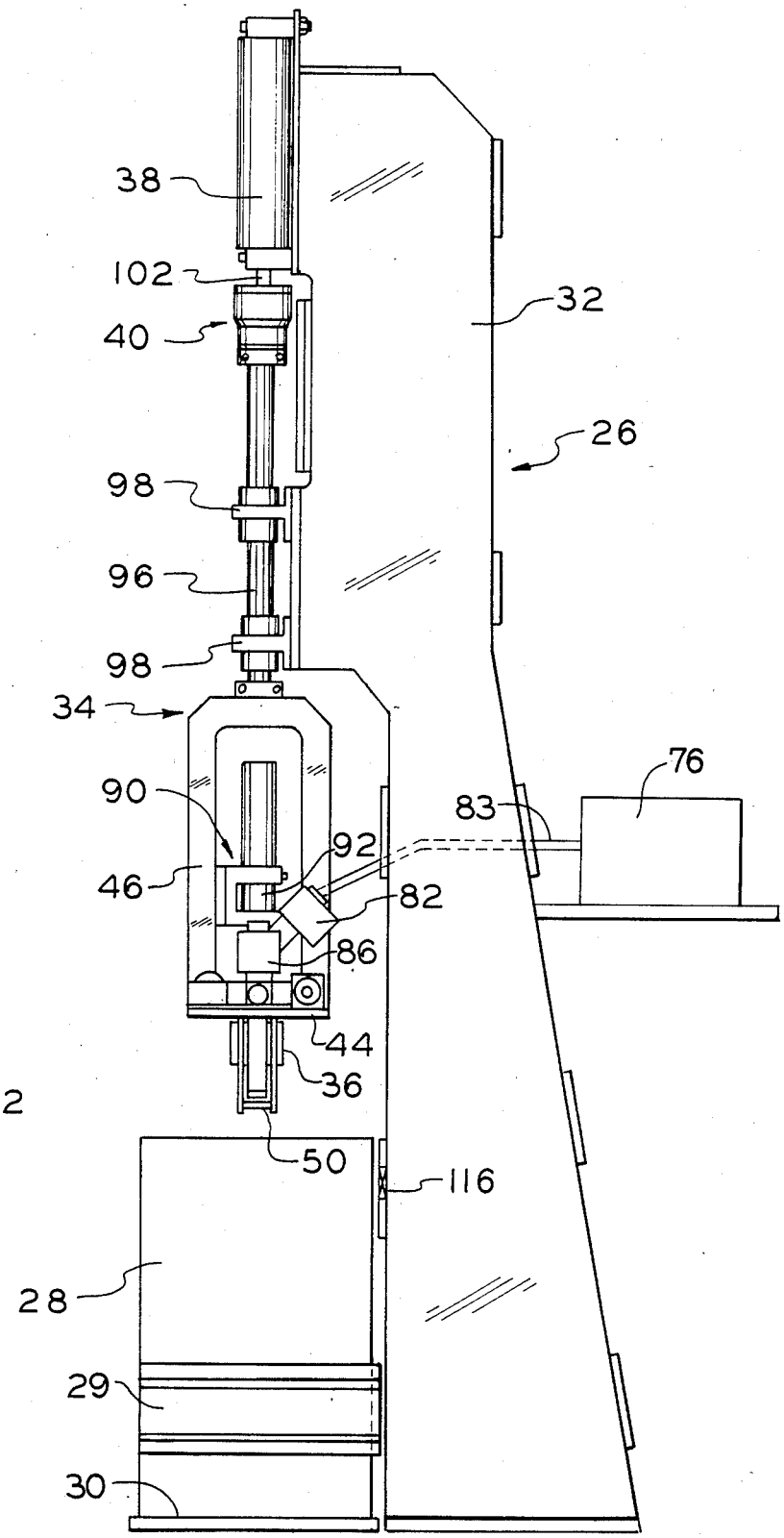
FIG. 2 is a side elevational view of a work station of the system of FIG. 1, a portion of the work station being illustrated in schematic form.
Figure 3:
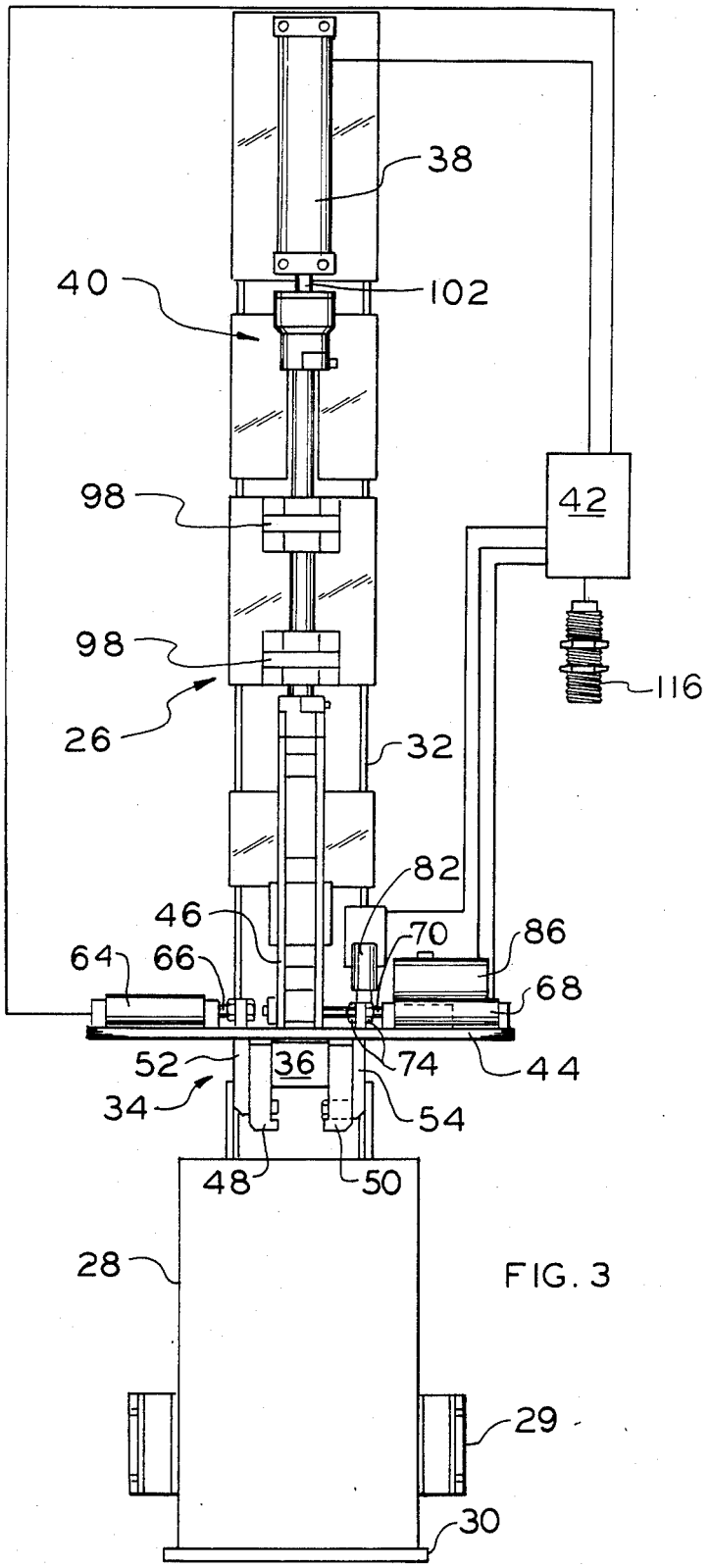
FIG. 3 is a front view of the work station of FIG. 2 and an associated controller illustrated in schematic form.

With reference to FIGS. 2 and 3, work station 26 comprises a generally vertically extending support frame 32 which extends upwardly relative to platform 30 for suspending a clamp/fill assembly from a vertical location above a received container 12 to be filled. The container is supported on platform 30 and received in nest 29 at the lower forward portion of the station. As will be further described below, a clamp/fill head 34 is adapted to be automatically lowered onto the received container for automatically clamping with the valve 14 for evacuating and filling the container. A torque head 36 (best illustrated in FIG. 5) is mounted to the clamp/fill head for automatically closing the valve 14 after the container has been filled with a pre-established weight of fluid. The clamp/fill head 34 is automatically raised and lowered by means of a pneumatically controlled cylinder 38 and a cooperating decoupling assembly 40 (best illustrated in FIG. 4). The operation of each work station and the operation of the entire automated assembly 10 is controlled by a programmable controller unit designated schematically by the numeral 42.

Figure 6:
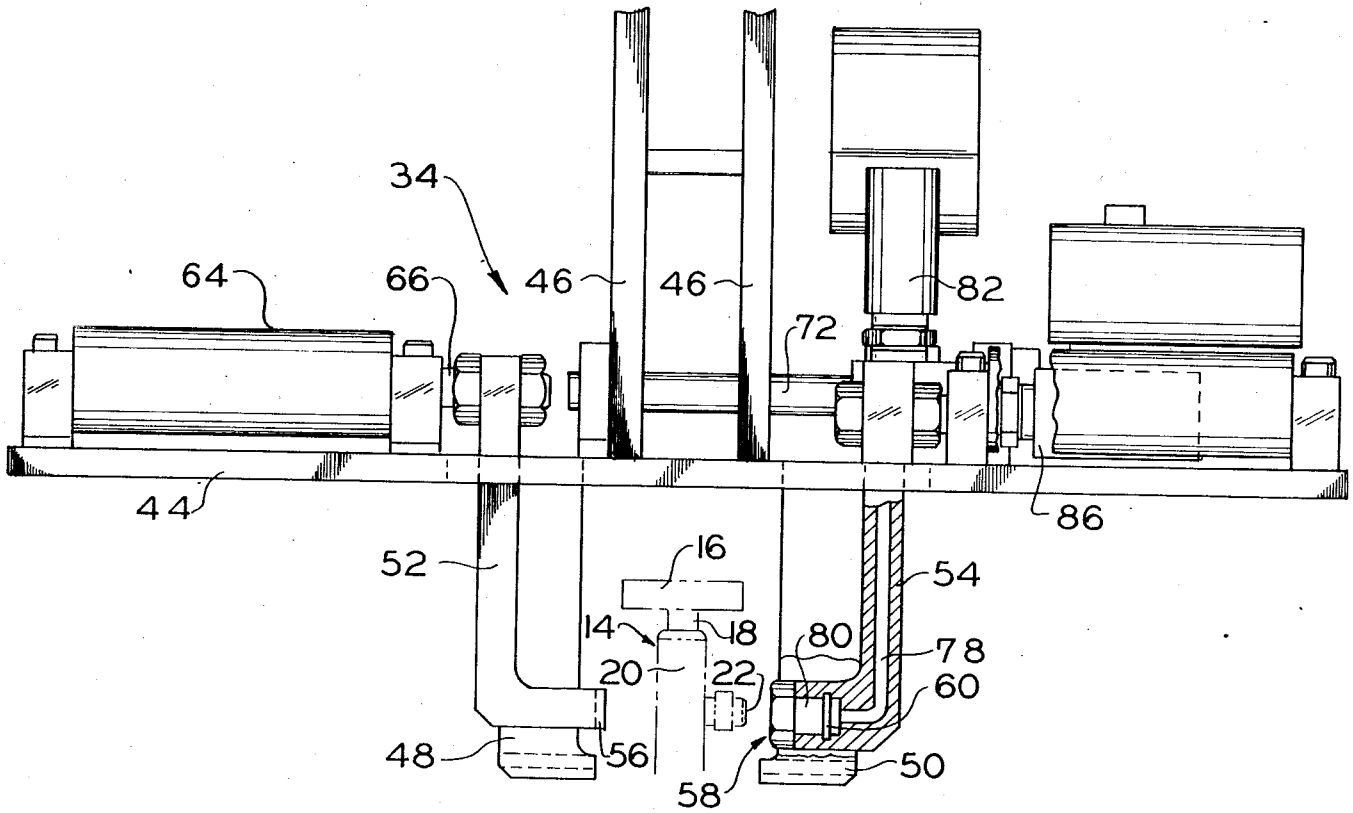
FIG. 6 is an enlarged fragmentary front view, partly in section and partly broken away, of the work station of FIG. 3 illustrating a clamp/seal assembly thereof with a portion of a container valve assembly being shown in phantom.

Clamp/fill head 34 includes a generally horizontally extending platform 44 which is suspended from generally vertically extending hanger supports 46 which are welded to the platform. A pair of cooperating support legs 48 and 50 extend downwardly from a central location of the platform to form a rest for engaging the top of the received container for resting the clamp/fill head thereon as best illustrated in FIG. 6. The legs are spaced and configured to intermediately accommodate the valve 14 at the top of the container 12 so that the valve does not impede or interfere with the engagement of the legs against the top of the container.

A clamp arm 52 and a seal arm 54 each having a generally L-shaped section extend downwardly from the platform and are generally cooperatively transversely positionable to engage at opposite sides of valve 14 to provide a clamping/sealing engagement therewith. The clamp arm 52, seal arm 54, and legs 48 and 50, are correspondingly dimensioned so that when the clamp/fill head rests on the container, the clamp arm 52 and the seal arm 54 engage the valve 14 at the correct vertical location. The terminus of clamp arm 52 forms a generally vertically extending V-shaped groove 56 which is configured and dimensioned to engage against the generally cylindrical wall of the valve body 20. The terminus of the seal arm 54 includes a sealing element or valve seat subassembly 58. The valve seat subassembly comprises an annular seal 60 which is mounted within a seal housing in the form of a bushing 62. The bushing has a nozzle receiving aperture adjacent the seal 60 and is threadably mounted within a formed port 80 of the seal arm so that the nozzle receiving aperture faces the retainer element on the end of the clamp arm. The annular seal 60 is dimensioned and configured to provide a press seal connection to the threaded nozzle 22 of the valve to thereby eliminate the requirement of a threaded connection to the valve nozzle. The annular seal 60 is preferably Teflon or the like material and is easily replaceable in bushing 62.

A solenoid controlled pneumatic cylinder 64 is bolted to platform 44. A control rod 66 projects exteriorly from the cylinder 64 and is linked to clamp arm 52 so that the transverse position of the clamp arm 52 is controlled by the pneumatic cylinder 64.

A second solenoid controlled pneumatic cylinder 68 is bolted to the platform 44. Pneumatic cylinder 68 functions to control the transverse position of the seal arm 54. The upper portion of seal arm 54 connects at a forward location with a transversely positionable control rod 70 which is controlled by the pneumatic cylinder. A guide rod 72 is mounted in generally parallel relationship to drive rod 70 by means of a pair of collars 74. A linear bearing assembly of the seal arm functions to slidably mount the seal arm to the guide shaft for transverse movement therealong so that the valve seat subassembly 58 at the terminus of the seal arm is positionable against the valve nozzle in an accurate aligned manner to provide a general fluid tight engagement.

A fluid passageway 78 extends from the port 80 at the valve seat subassembly to a vacuum valve 82 which is mounted at the top of the seal arm. Vacuum valve 82 is an electrically controlled valve which controls fluid communication between a vacuum line 83 leading from a vacuum pump 76 to selectively connect the passageway with a low pressure source for evacuating the container. In a preferred form, each work station has an independent vacuum pump 76 and low pressure supply system with each of the vacuum valves 82 being responsive to a vacuum gauge 85 for terminating communciation between the vacuum source and the passageway 78 when a pre-established low pressure threshold is obtained in the passageway. Each vacuum pump 85 is preferably mounted to a bracket which extends laterally from an intermediate vertical location of the support frame 62. The vacuum gauge 85 is interposed in the vacuum line 83 upstream from the vacuum valve 82.

Figure 7:
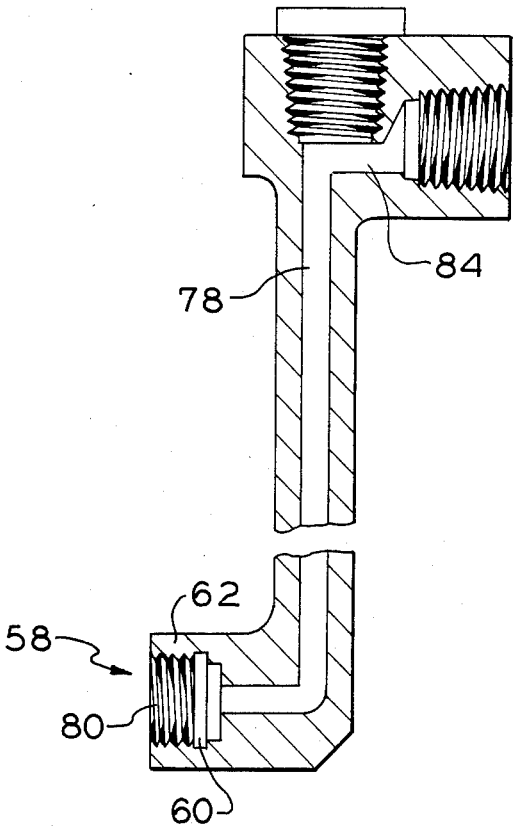
FIG. 7 is an enlarged fragmentary front sectional view of a portion of the clamp/seal assembly of FIG. 6.

With reference to FIG. 7, fluid passageway 78 also includes a transverse section 84 which leads to a fill valve 86. Fill valve 86 controls fluid communication between the fluid passageway and a line 87 (illustrated in FIG. 1) delivering the pressurized fluid to be forced into the containers. Fill valve 86 is an electrically controlled pilot valve. A pilot valve is ordinarily required because of the high rate of high pressure fluid flow through the fill lines. The pressure of the fluid may function to facilitate the closing of the valve. Fill valve 86 is responsive to various commands as will be further described below. In preferred form, the lines leading to each of the fill valves 86 connect to a common source of pressurized liquified fluid by a rotary union 88 positioned at a lower portion of the support assembly 24.

Figure 5:
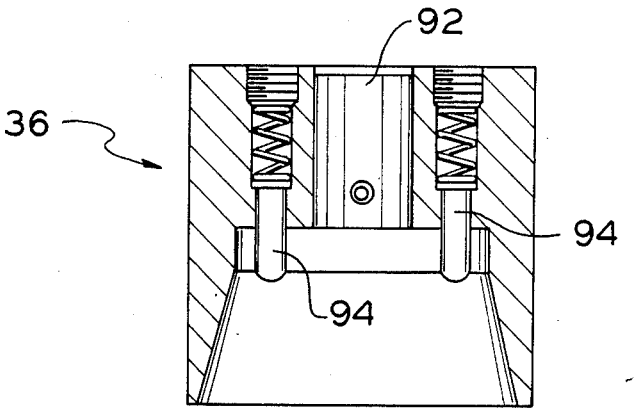
FIG. 5 is an enlarged fragmentary side sectional view of the work station of FIG. 2 illustrating a torque head assembly thereof.

A pneumatic driver assembly 90 is mounted at the top of platform 44 for pneumatically driving drive shaft 92 until a pre-established torque threshold is attained at which time the rotational drive of the shaft terminates. The lower end of drive shaft 92 is received in the torque head 36 in fixed rotational relationship therewith. With reference to FIG. 5, torque head 36 includes a tapered cup-like recess which is configured and dimensioned to receive and downwardly engage handle 16 of the container valve 14 for torquing the valve to the closed position upon termination of the filling of the container. A pair of spring loaded drive pins 94 project downwardly from opposite sides of the torqu head for laterally engaging the valve handle 16 and torquing the handle to the closed position. The drive pins 94 are spring loaded so that in the event that the pins directly align with the top of the handle the pins will be upwardly depressed until the torque head rotates slightly to allow the pins to extend downwardly for torquing engagement with the handle. As best illustrated in FIG. 2, the torque head is located below the bottom surface of platform 44 above the lower terminus of the clamp arm 52 and the seal arm 54 in a spacial relationship which corresponds to the spacial relationship between the handle 16 and the valve body 20 of the container to be filled.

The top of the clamp/fill head 34 is connected to the lower end of a control shaft 96 which is vertically displaceable for raising and lowering the clamp/fill head 34. A pair of linear bearing pillow blocks 98 are fastened to a forward side of the support frame 32 for receiving control shaft 96. The foregoing pillow blocks function to provide a low friction guidance system for the control shaft 96 and make it possible to convert fill head to tare weight. The decoupling assembly 40 functions to selectively decouple the upper end of the control shaft from a coupled engagement with a control rod 102 which is controlled by a solenoid operated pneumatic cylinder 38. The pneumatic cylinder 38 is fastened to the top forward side of the support frame 32 and functions to raise and lower the clamp/fill head and the associated torque head onto the container.

Figure 4:
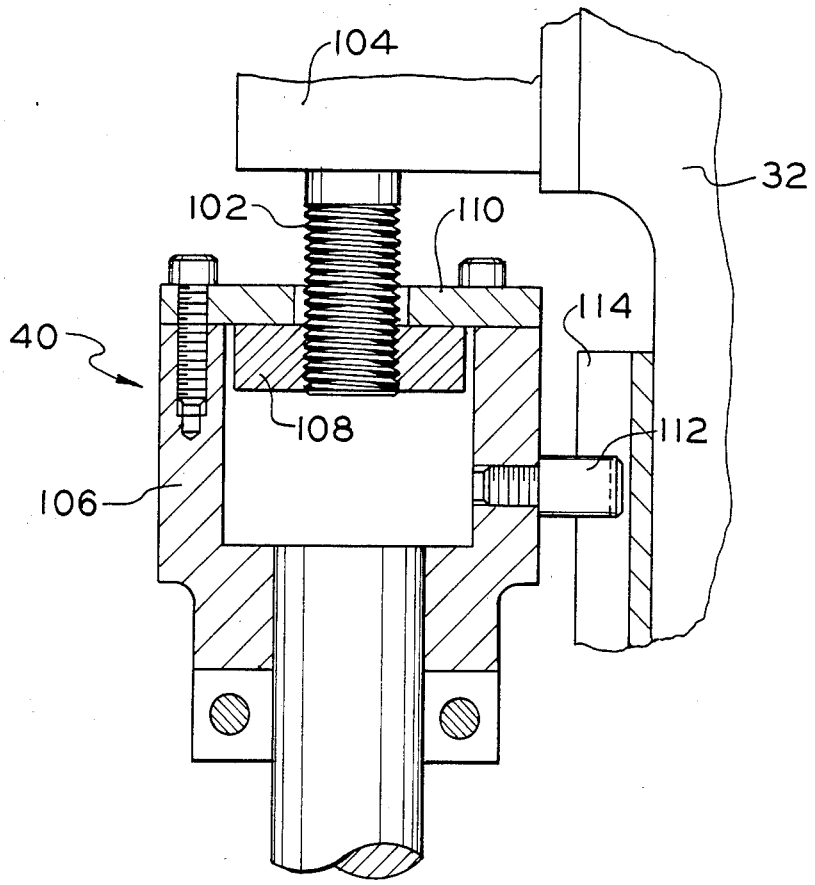
FIG. 4 is an enlarged fragmentary side sectional view illustrating a decoupler assembly of the work station of FIG. 2.

With reference to FIG. 4, decoupling assembly 40 comprises a clamp case 106 which is clamped against the top of control shaft 96. The upper interior portion of case 106 forms a generally cylindrical cavity having a vertical central axis. A collar 108 is threaded to the end of control rod 102. A cover plate 110 forms a central opening for receiving control rod 102. The cover plate 110 is bolted across the top of case 106 to capture collar 108 in the upper cavity of the case. The foregoing arrangement functions so that the upper surface of the collar 108 engages the lower surface of the cover plate 110 to support the clamp fill assembly. The stroke of the control rod 102 is exaggerated to permit the rod to be lowered beyond the rest position defined by the legs 48 and 50 of the clamp/fill head engaging the container. The clamp case position becomes fixed at the rest position and continuing lowering of the control rod causes the vertical position of collar 108 to be lowered to a vertical height which permits the collar to disengage from the cover plate and to be vertically displaced out of coupling support engagement into the case cavity. A cam follower 112 projects from a side of case 106 and travels along a vertical track 114 which is connected to the support frame 32. The function of the follower/-track arrangement is to provide in combination with the linear bearing blocks 98 a low friction linear guidance system with minimal torque for shaft 96 so that the clamp/fill assembly may be essentially freely supported on the container to be filled.

Platform 30 of each of the work stations functions as a weighing platform or a scale so that the tare weight of the container contents may be efficiently determined. The platform is preferably a component of a digital readout scale having a tare weight capacity on the order of 100 lbs. and a sensitivity on the order of 0.01 lbs. with a substantially unlimited tare weight control. The weight of the freely loaded clamp/fill assembly and the container can be rather easily calculated or zeroed out. The decoupling assembly 40 functions to release the clamp fill unit so that the unit is supported on the container in a manner which allows for a relatively accurate determination of the tare weight. Ordinarily the tare weight of the contents of a filled container is on the order of approximately 30 lbs. and the required accuracy is on the order of +1%.

Figure 8:
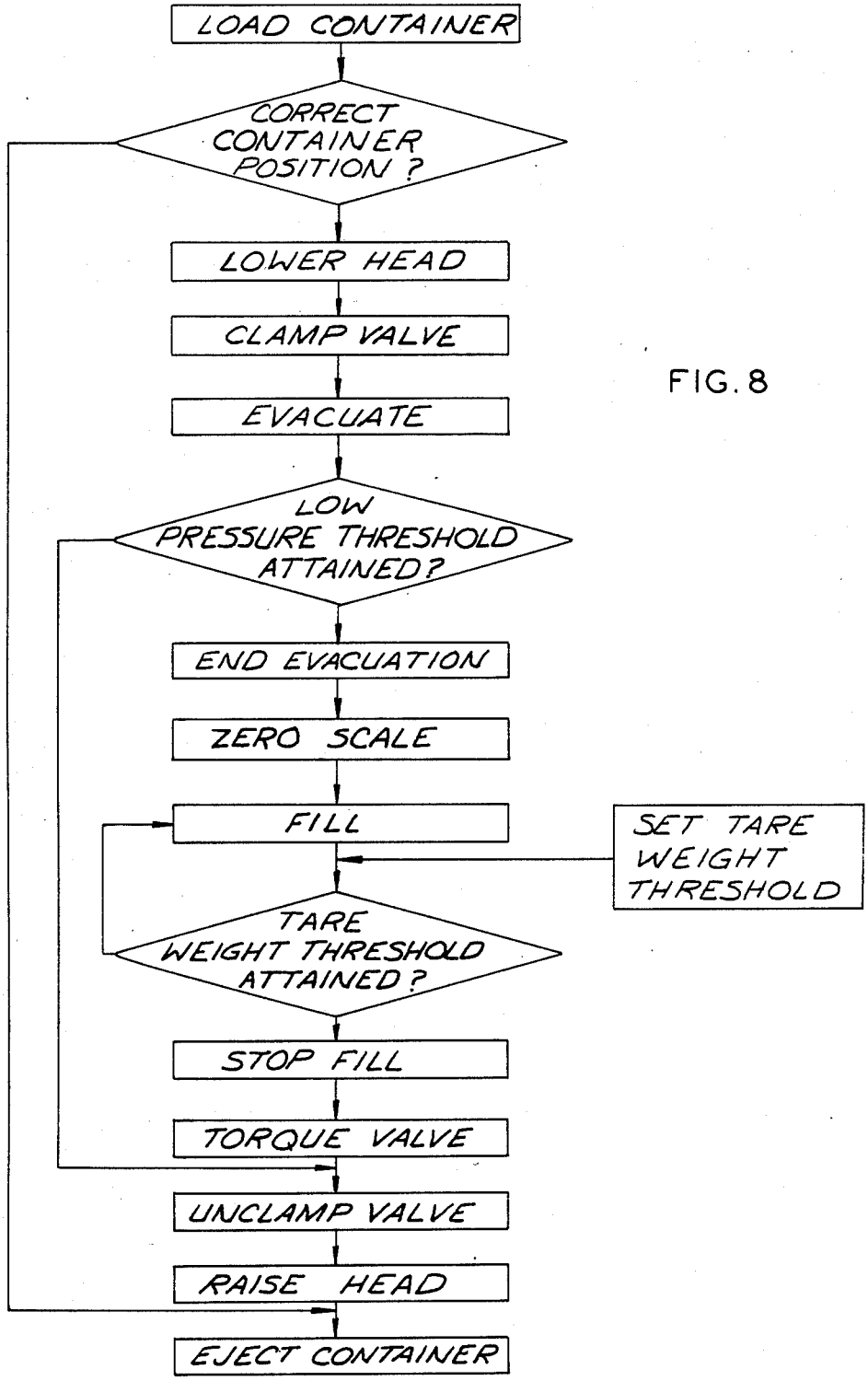
FIG. 8 is a flow diagram illustrating a method for charging containers in accordance with the present invention.

The operation of the foregoing automated filling assembly 10 is automatically controlled by a programmable controller unit 42 which receives various input signals and transmits various responsive output signals as will be more fully described below. The controller synchronizes and controls the operations of each work station and also coordinates the sequence of operations of each station in relation to the other work stations. The general operation of the automated filling assembly may best be appreciated by reference to the flow diagram of FIG. 8. The support assembly 24 continuously rotates at a relatively low speed such as ¼ revolution per minute and continuously sequentially receives empty containers, evacuates the containers, fills the containers with a pressurized liquid such as a liquid refrigerant gas, closes the container valve and ejects the filled containers from the support assembly. Automatic means are also provided for rejecting defective containers or misloaded containers.

The boxed container is first received on the platform 30 in nest 29 of a work station 26 which is continuously rotating. A proximity sensor 116 is positioned on the work station in the vicinity of nest 29 for detecting that the container is correctly oriented. The proximity sensor output ordinarily initiates the program in the controller 42. The containers are pre-positioned in the final packaging boxes in a manner wherein the normal receiving of the box into the work station nest ill provide a correct orientation of the container and its associated valve. In the event that the metal of the container is not detected by the proximity sensor 116 within a given detection zone, an appropriate electrical signal will be transmitted to the controller for by-passing the normal evacuating, filling and closing operations. The misoriented container will then be sequentially ejected from the automated filling assembly.

In the event that the proximity sensor 116 detects a correct orientation of the container, an appropriate signal is received at the controller unit, and the controller unit generates an electrical signal to a solenoid which controls pneumatic cylinder 104 for lowering the clamp/fill assembly onto the received container. When the support legs 48 and 50 engage the container top, the clamp/fill assembly essentially decouples from the control rod 102 at the decoupling assembly 40 so that the clamp/fill head 34 is freely supported on top of the container. The controller transmits appropriate electrical signals to the solenoid controls of pneumatic cylinders 64 and 68 for clamping the valve 104 of the container and press sealing the valve seat subassembly 58 against the nipple of the valve nozzle 22 to form a fluid tight engagement.

Vacuum valve 82 is opened so that the vacuum pump 76 is connected with the container interior for evacuating the container. Naturally, fill valve 86 remains closed during the evacuating sequence. The vacuum valve 82 remains open until a pre-established low pressure threshold is attained in the vacuum system as sensed by vacuum gauge 85 or until 35 seconds have elapsed—whichever occurs first. The preferred low pressure threshold is 29.8 inches of mercury. If there is a small leak in the container, the automated filling assembly will identify the container for rejection since ordinarily the threshold low pressure level will not be attained in the 35 second interval. In the event that the container is identified for rejection, the sequence of operations for the given work station will be by-passed and the clamp-/fill head released from the clamping engagement with the valve 14. The clamp fill assembly will be raised and the container sequentially rejected from the assembly.

At the termination of the evacuation process, a zero scale tare weight determination is made and an appropriate input is transmitted to the controller. Vacuum valve 82 is closed to terminate the evacuation. Fill valve 86 is opened a short time thereafter. Fill valve 86 is a pilot operated valve connecting with a two-inch fill line 87 for pumping liquid refrigerant gas at approximately 250 psi. through the fluid passageway 78 into the container 12. The filling of the container continues until the tare weight of the container contents attains a threshold level which will finally yield the pre-established desired contents weight which may for example be 30 lbs. Upon attaining the threshold fill weight, which may in practice be on the order of 29.5 lbs., a signal is transmitted to fill valve 86 for closing the valve. The dynamics of the automated filling system and the residual fluid in the system in passageway 78 will complete the final 30 lbs. charge.

The container is ordinarily filled to approximately three-fourths volume capacity. It should be appreciated that thermal expansion is quite violent for liquified gases and ordinarily subjecting the container to a temperature of 130° F. would result in the liquified gas expanding from a three-fourth container volume at normal temperature to completely occupy the container. After the fill valve is closed, the residual liquified gas in the passageway 78 continues to flow to the container under the force of gravity. It is desirable to minimize any escape of the liquified gas to the atomosphere or surrounding environment. Therefore, the torquing of the valve handle 16 to close the container valve is ordinarily delayed for a given time interval on the order of 5 seconds to allow the residual liquified gas to drain into the container and to prevent escape to the environment. Substantially all of the liquified gas will ordinarily drain into the container since the vapor pressure is on the order of 100 psi.

After the given drain time interval, the controller transmits an appropriate electrical signal to the pneumatic driver assembly which proceeds to drive the torque head 36 for torquing the valve handle 16 to the closed position. The pneumatic driver assembly is an air operated driver which has a clutch set for approximately 35 lbs. per inch so that the torque head terminates the torquing at the torque threshold.

The pneumatic cylinders 64 and 68 are then actuated and clamp arm 52 and seal arm 54 are accordingly withdrawn from the container valve. Pneumatic cylinder 104 is actuated for retraction so that collar 108 re-engages the bottom of cover plate 110 of the decoupler assembly to raise the clamp fill head from the container. The container is then ejected from the automated filling assembly unit. The ejected container is essentially packaged, accurately filled and ready for distribution.

It should be of course appreciated that the foregoing sequence of operations is essentially replicated in a staggered time sequence at each of the other work stations of the automated filling assembly. In a preferred form, the evacuating sequence lasts for approximately 35 seconds and the filling sequence for approximately 45 seconds. For an automated filling assembly employing 8 work stations, approximately 350 containers per hour may be evacuated and filled.

The foregoing automated filling assembly provides an efficient automated system wherein the containers may be individually pre-screened and pre-sampled prior to filling each of the containers. The containers may be accurately filled and the container valve automatically closed at the same work station that is employed for evacuating the containers. The controller of course may be programmed to accommodate a wide variety of fluids employed for filling the containers. It should also be appreciated that the foregoing system may be dimensionally adapted to accommodate a wide variety of containers and container valve configurations. It should also be noted that the foregoing system can control the filling valve assembly by way of pressure switches when the containers are being filled with a non-liquified gas.

While a preferred embodiment of the foregoing invention has been set forth for purposes of illustration, the foregoing description should not be deemed a limitation of the invention herein. Accordingly, various modifications, adapatations and alternatives may occur to one skilled in the art without departing from the spirit and scope of the present invention.

What is claimed is:

1. An automated system for charging containers of a type having a valve controlled by a rotatable handle with a loquified refrigerant gas or like fluid comprising:

receiving means to receive and support a container to be charged in a generally upright orientation;

support frame means;

fill head means suspended from said frame means, said fill head means being disposed generally above said receiving means, said fill head means comprising vacuum source conduit means for connecting with a low pressure source and fluid supply conduit means for connecting with a source of pressurized fluid, a fluid passageway selectively communicatable with said vacuum source conduit means and said fluid supply conduit means and a valve seat surrounding said fluid passageway;

clamping means mounted on said fill head means to clamp said valve seat in a pressure engageable fluid tight relationship with said container valve to provide fluid communication therebetween;

vacuum control means to selectively control communication between said vacuum source conduit mean and valve seat means;

fluid control means to selectively control communication between said fluid supply conduit means and valve seat means;

fill head displacement means releasably coupled to said fill head means for selectively raising and lowering said fill head means; and decoupling means to controllably release said fill head means from coupled relationship with said displacement means to allow said fill head means to rest on a received container so that said container may be automatically sequentially evacuated and filled with a pre-established amount of a pressurized fluid.

2. The automated system of claim 1 further comprising a torque means to automatically close said container valve after said vessel is filled with the pre-established amount of pressurized fluid.

3. The automated system of claim 1 wherein said decoupling means further comprises a control rod, a collar mounted at the end of said control rod and a coupling plate mounted in fixed relationship to said fill head means so that said control rod may be positioned in a first operational mode wherein said collar engages said plate to support said fill head means and may also be positioned in a second operational mode wherein said collar disengages from said plate to allow said fill head means to freely rest on a container received by said receiving means.

4. The automated system of claim 1 wherein said clamping means further comprises a pair of pneumatically controlled clamp arms which cooperate to clamp the valve seat in a pressure engageable fluid tight relationship with the container valve.

5. The automated system of claim 1 further comprising a vacuum sensing means interposed in said vacuum source conduit means to sense whether the received container has a leak.

6. The automated system of claim 2 wherein said torque means further comprises a head forming a cup-like cavity and a pair of spring mounted pins projecting into said cavity with said pins adapted to engage said valve handle for rotating said handle to a closed position.

7. The automated system of claim 1 wherein said receiving means further comprises a weighing platform for weighing said container and fill head means to determine the tare weight of the contents of said container.

8. The automated system of claim 1 further comprising controller means to automatically sequentially control the operation of said fill head means, clamping means, vacuum control means, fluid control means, and said decoupling means.

9. A method for charging containers with a liquified refrigerant gas or like fluid comprising;

orienting a container to be charged in a generally upright orientation within a rotating assembly;

lowering a fill head assembly onto said container so that said fill head assembly freely rests on said container;

automatically clamping said fill head assembly to said container to provide fluid communication therebetween;

evacuating said container through said fill head assembly until a pre-established low pressure threshold is attained;

filling said container with fluid through said fill head assembly while said fill head assembly freely rests on the container weighing the container, the fluid in the container, and the fill head assembly to obtain the net weight of the fluid in the container; and terminating filling said container with fluid when the weight of the fluid in the container reaches a pre-established weight.

10. The method of claim 9 further comprising the step of automatically closing the container after said container has been filled.

11. The method of claim 10 wherein the evacuating step further comprises opening and closing a vacuum valve to provide selective fluid commununication with a source of low pressure.

12. The method of claim 10 wherein the filling step further comprises opening and closing a pilot valve to provide selective fluid communication with a source of pressurized fluid.

13. The method of claim 12 further comprising delaying the step of closing the container for a pre-established time interval subsequent to the closing of said pilot valve to allow residual fluid to drain into said container.

14. The method of claim 9 further comprising automatically sequentially controlling each of said steps by means of a programmable controller.

15. The method of claim 9 further comprising the step of automatically detecting a leak in said container by detecting when said pre-established low pressure threshold is not attained within a pre-established time interval.

16. The method of claim 9 further comprising the step of automatically determining whether the container is properly positioned in the rotating assembly.

* * * * *